US005107765A

United States Patent [19]

Schippers

[11] Patent Number: 5,107,765

[45] Date of Patent: Apr. 28, 1992

[54] PROCESS AND DEVICE FOR TRIGGERING AN AVALANCHE

[76] Inventor: Jacob Schippers, Quartier Le Bresson, Le Touvet, France, 38660

[21] Appl. No.: 435,428

[22] PCT Filed: Mar. 2, 1989

[86] PCT No.: PCT/EP89/00211

§ 371 Date: Nov. 2, 1989

§ 102(e) Date: Nov. 2, 1989

[87] PCT Pub. No.: WO89/08234

PCT Pub. Date: Sep. 8, 1989

[30] Foreign Application Priority Data

Mar. 3, 1988 [FR] France ..... 88 02902
Sep. 19, 1988 [FR] France ..... 88 12358

[51] Int. Cl.[5] ..... F42D 3/00

[52] U.S. Cl. ..... 102/302; 102/301; 89/1.1; 89/1.4; 37/197; 37/201

[58] Field of Search ..... 102/301, 302; 37/201, 37/196; 89/1.11, 1.14, 1.1

[56] References Cited

U.S. PATENT DOCUMENTS 3,048,816 8/1962 Lubnow ..... 340/12
3,600,116 8/1971 Clark, Jr. et al. ..... 431/1
3,924,897 9/1975 Colburn, Jr. et al. ..... 299/36
3,963,275 6/1976 Godfrey et al. ..... 299/13
4,817,529 4/1989 Schippers ..... 102/302

FOREIGN PATENT DOCUMENTS 1287597 1/1969 Fed. Rep. of Germany .
1093237 5/1955 France .
1378962 11/1964 France .
2609331 7/1988 France ..... 37/196
80/01511 7/1980 World Int. Prop. O. .

*Primary Examiner*—Brooks H. Hunt
*Assistant Examiner*—Chrisman D. Carroll
*Attorney, Agent, or Firm*—Davis Bujold & Streck

[57] ABSTRACT

The above device consists mainly of a rigid explosion tank (10) with a closed rear end (11) and a front opening (12). Said tank is mounted in the direction of the slope on which the avalanche is to be triggered. It is connected to a fuel gas supply station (19) and to an oxygen-carrying gas supply station (20). These two stations are linked by pipes (17 and 18) to injection nozzles (16) situated inside the tank (10). An ignition device (29) is mounted in the bottom of the tank and can be operated by remote control by means of a triggering device (30). An advantage of the above device is that the explosion is exponentially propagated inside the rigid explosion tank and causes a powerful high-velocity blast to be expelled from the latter.

22 Claims, 9 Drawing Sheets

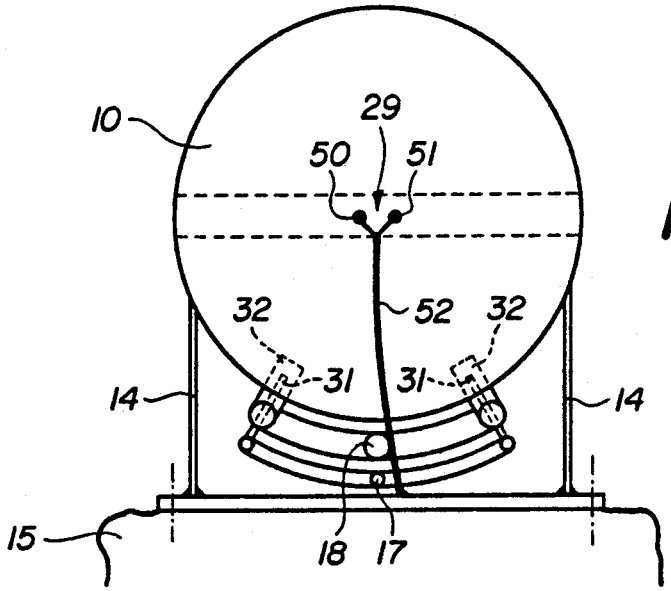
FIG. 3
FIG. 4
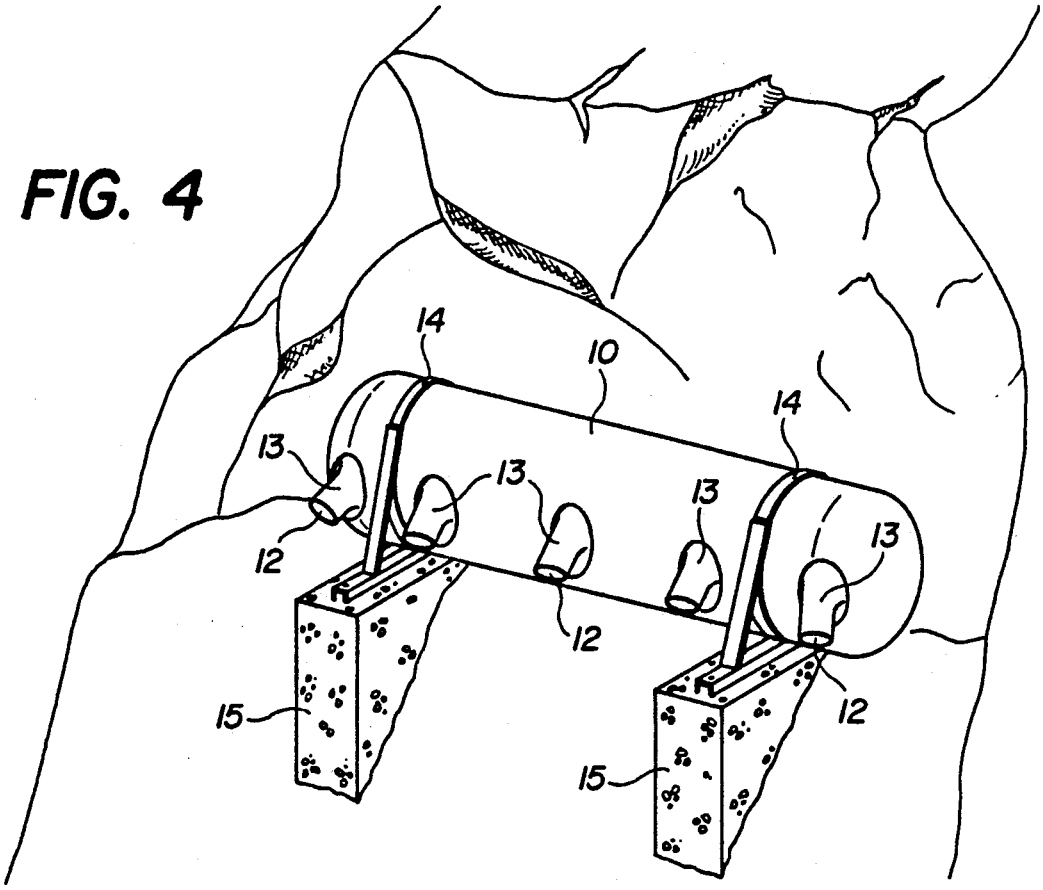

PROCESS AND DEVICE FOR TRIGGERING AN AVALANCHE

FIELD OF THE INVENTION

The present invention concerns a method for launching an avalanche, in which one or several explosions of an explosive material are generated in a predetermined zone from which the avalanche is to be launched.

A device is also described for the use of this method to launch an avalanche, including means of generating at least one explosion of an explosive material in a predetermined zone from which the avalanche is to be launched.

DESCRIPTION OF THE RELATED ART

There is a well known commercialised system known as C.A.T.E.X. which is provided with cables transporting explosives for the preventative launching of avalanches. This system transports charges of dynamite by cable which, led up above the corridor of the avalanche to be dealt with, explode causing a rush of snow. A shot given after each heavy snow fall prevents an accumulation which may be dangerous. This system consists mainly of a collection of pylons which support a closed loop of a transporting cable which pass above one or several avalanche corridors. This device consists of a machine lowering a charge which may be of the lowering crane type with slow fuse, or with time switch, or with microprocessor or radio-controlled crane.

In each case, the explosive charge is brought to a roughly constant distance above the upper surface of the layer of snow which is to be made to move, and is exploded causing a shock wave which travels in all directions. In general, the part of this shock wave which travels to the snow layer starts its movement and launches the avalanche. Even through the system has demonstrated its efficiency through the numerous installations erected during the last fifteen years, it does however have certain drawbacks. The installation of the cable circuit which necessitates the erection of numerous pylons supporting the cable is a difficult and very costly operation, which strongly limits the possibilities of implantation of this system. Also during the explosion, only a relatively limited part of the energy released by the charge acts on the snow layer, given that the blast and shock wave travel in spherical waves in all directions of space. From this the efficiency of the system is relatively modest and the explosive charges must be important with respect to the results to be obtained.

Also the manipulation of the explosive charges is always a dangerous operation no matter what precautions are taken by the operators.

SUMMARY OF THE INVENTION

The present invention presents a solution to the above mentioned disadvantages and describes a simple and effective method to launch an avalanche in all the sites to be protected.

This aim is achieved by the method according to the invention in which at least one explosion is caused of a mixture of carburant and a gaseous oxidant material within an explosion tank at least partially open at one end and situated in said predetermined zone.

According to the one embodiment of the method a combustible gas is used as gaseous carburant. This combustible gas is preferably chosen from a group of substances comprising hydrogen, petrol residues (such as tetraine commercialized by the french company Air Liquide), acetylene, propane, methane or a mixture of these substances, and as gaseous oxidizing agent oxygen or ozone may be used. Air or air enriched with oxygen or ozone may also be used as oxidising agent.

In the method according to the invention, a gaseous mixture composed of at least approximately 1/6 by volume of carburant and of 5/6 by volume of oxygen is used. This mixture is best done at atmospheric pressure.

Preferably, the gaseous carburant and the gaseous oxidising agent are introduced simultaneously into the rigid explosion tank by means of a mixing device designed to produce a homogeneous mixture. The explosion of the mixture is best caused by means of a spark produced in the interior of the rigid explosion tank, in a zone situated near one of the inner walls opposite its open end.

The explosion tank is best situated near the ground and with the opening directed along the slope of the land in the said predetermined zone.

Filling of the rigid explosion tank is advantageously carried out by valves operated manually or at a distance and the spark is produced by a piezo-electric device. The spark may also be produced by a device containing a flint activated by a controlled mechanism.

According to a preferred embodiment, the explosion is caused in an explosion tank having the shape of a cannon comprising a closed base and a front mouth, and the blast resulting from the explosion is directed above the layer of snow to be swept away by the said avalanche and the shock wave resulting from the explosion is to be propagated below and within this layer of snow.

Preferably, the explosion is caused in an intermediate zone situated between the closed base and the front mouth of the cannon.

Preferably the explosive mixture is prepared by passing the carburant gas and the oxidising agent gas from their respective pressurised containers across buffer tanks where they are under a pressure which is between the pressure of the said containers and the atmospheric pressure.

The explosive mixture may also be prepared by passing the carburant gas and the oxidising agent gas from their respective containers under pressure, across flow meters to measure the respective volumes of these components.

The device constructed according to the invention consists of a rigid explosion tank situated in the predetermined zone, the said tank comprising at least one opening at one of its ends, means of filling this tank with a gaseous mixture of a carburant and of an oxidising agent and means of causing an explosion within the said rigid explosion tank.

According to one embodiment, the device consists of at least one container for the carburant and a container for the oxidising agent, ducts to link the respective containers to the said rigid explosion tank, and valves mounted on these ducts to permit the passage of carburant and oxidising agent to the said rigid explosion tank. This tank is equipped with means of mixing designed to ensure the homogeneity of the gaseous mixture in the explosion tank. It also comprises means of causing a spark in the interior of the tank.

According to another embodiment, the rigid explosion tank is mounted close to the ground and its open end is directed roughly along the slope of the land in the said predetermined zone.

The tank is in the form of a cylinder closed at one end and comprising at least one front opening whose section is less than the diameter of the tank, this opening being led back to the main part of the tank by a cone-shaped section.

Preferably the ignition device designed to cause a spark is mounted on the closed base of the cylindrical rigid explosion tank.

Preferably the rigid explosion tube is in the form of a cannon comprising a closed base and an open mouth, the closed base being anchored to the ground and the front mouth opening out above the layer of snow to be carried away by the said avalanche. The cannon is equipped with means of causing a spark in an intermediate zone between the closed base and the front mouth.

According to an embodiment, the open mouth of the cannon is equipped with means assuring the propagation of the blast resulting from the explosion and the closed base is embedded in a massive unit anchored to the ground.

To propagate the blast caused by the explosion the front mouth of the cannon opens out.

The cannon may also have an elongated shape and comprises a progressive decrease of section in the direction of the front mouth.

Preferably the igniting device is piezo-electric. It may also comprise a flint or an electric igniter.

The ignition device may comprise ignition electrodes associated with a high voltage source to create an arc between the said electrodes.

According to a particular embodiment, the rigid explosion tank has a cylindrical shape and comprises several mouths led back by cone-shapes, arranged along the side wall.

BRIEF DESCRIPTION OF THE DRAWINGS

The present invention is better understood by referring to the description of the examples and the annexed drawings in which:

FIG. 3 represents a view of a transverse section of the explosion tank used in the embodiment shown in FIG. 1.

FIG. 4 represents a perspective view of another embodiment in which the rigid explosion tank is situated sideways and comprises several openings.

DETAILED DESCRIPTION OF THE PREFERRED EMBODIMENT

Figure 1:
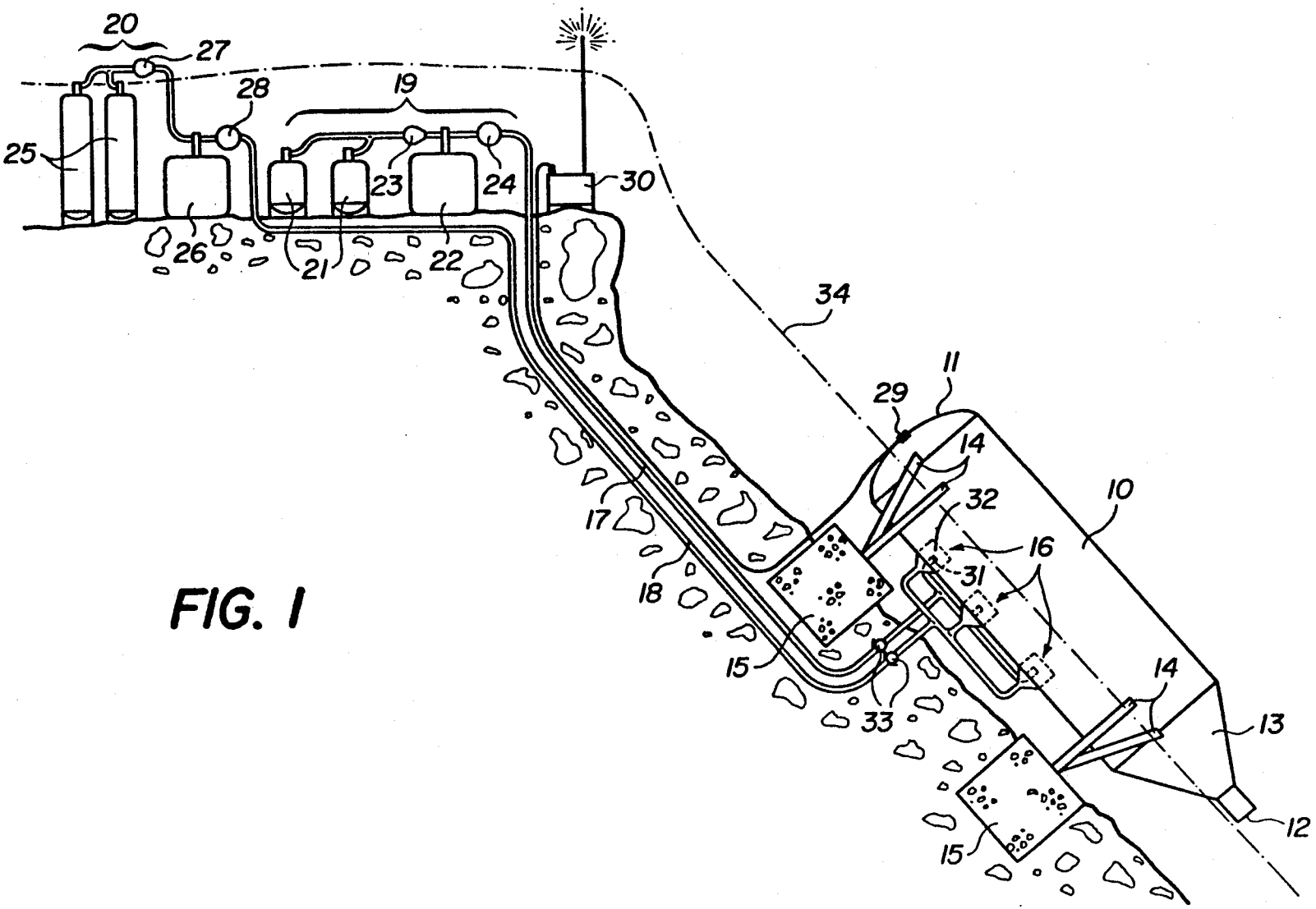
FIG. 1 represents a schematic view of one embodiment of the device according to the invention in which oxygen is used as oxidising agent.

With reference to FIG. 1, the device represented is essentially composed of a rigid explosion tube of cylindrical shape, having a closed base 11 and a mouth 12 arranged at the opposite end to the closed base 11, this mouth being situated at the end of a narrowed section 13 which has an substantially truncated section.

The tank 10 is solidly anchored to the ground by means of metallic arms 14 soldered on end to the rigid explosion tank 10 and on the other end to the mass of anchorage blocks is preferably made from reinforced concrete.

The explosion tank 10 is equipped on its bottom with injection outlets 16 which are linked by means of two conduits 17 and 18 to a supply of carburant 19 and to a supply of oxidising agent 20 respectively. The supply station 19 of carburant is composed, for example of two bottles 21 of prepare gas maintained in the usual liquid state, of a buffer tank 22 linked to the bottles 21 by a pressure-reducing valve 23, and a valve 24 positioned at the exit of the buffer tank and which controls the injection of the carburant gas into the rigid explosion tank 10. The buffer tank 22 is designed to contain carburant gas at a pressure of the order of 3 bars. The valve 24 can be controlled by manual mechanic electromagnetic, etc, means.

The supply station 20, for the oxidising agent may consist of two bottles 25 containing oxygen stocked in the liquid state, of a buffer tank 26 linked to these bottles via a pressure reducing valve 27 and a valve 28 identical to the valve 24, which controls the injection of oxygen into the rigid explosion tube 10. As before, the filling tube 26 is designed to receive gas at a pressure of the order of 3 bars, and the valve 28 may be controlled by manual, mechanic, electromagnetic etc, means.

To bring about the explosion, a spark is produced by an ignition device 29 mounted on the bottom 11 of the rigid explosion tank 10. This spark may be produced by various means which will be described later, and preferably produced by a remote controlled device 30 mounted near the supply stations of carburant and oxidising agent.

The injection nozzles of the two gases in the explosion tube 10 each have an injector 31 of carburant which is mounted directly in the centre of an injector 30 of oxidising agent which has the shape of an opened out funnel directed towards the interior of the tank. This arrangement allows the homogeneous mixing of the two gases injected into the tank, and assures the maximal efficiency of the explosion induced.

As concerns security, the conduits 17 and 18 are respectively equipped with two non-return valves 33 which prevent the explosive mixture from entering the tubes and reaching the feed tank. It is noted that the explosion tank 10, and particularly its mouth 12 are directed in the direction of the slope and mounted at a relatively small distance from the ground so that the tube formed by the orifice of the explosion tank 10 is situated at the height of the layer of snow to be evacuated which is shown by the line 34.

The device functions in the following manner: the operator controls the simultaneous opening of the valves 24 and 28 and causes the filling of the rigid explosion tank 10 by means of a homogeneous mixture of carburant oxidising agent at atmospheric pressure. The amounts are calculated so that when the tank is full it contains approximately 1/6 of the carburant and 5/6 of oxidising agent. When the filling is completed, a spark is produced by the ignition device 29 and causes the explosion which travels exponentially along the tank towards the mouth 12. Because of the narrowing to a funnel shape in the zone of the mouth 12 and of the truncated section 13, an extremely powerful blast and shock wave are created which have the effect of moving away and mobilising the mass of snow to be evacuated. Given that the tube is rigid enough to resist the explosion and that the mouth is directed along the angle of the slope, the blast of the explosion is directed exactly along the line of the slope hence with maximal efficiency. Using a rigid tank therefore is an essential element which allows the directing of the blast and avoids it being spread in all directions and therefore wasting energy. It has been noted that when the ignition device 29 was mounted within the tank 10 in a position removed from the bottom 11 of the tank the efficiency of the explosion was less. The best results are obtained with an elongated tank as ignition device mounted inside on the closed base of the tank and an mouth linked to the body of this tank by a narrowing zone.

All these characteristics are found in the different embodiments described below. The device in FIG. 2 differs from the above description in that air is used as the oxidising agent. It consists, as before, of a rigid explosion tank 10 with a closed base 11 and a front mouth 12. The explosion tank however is provided with a funnel 40 which ensures the arrival of air into the tank. This funnel must be sufficiently high to protrude from the surface of the layer of snow 34. In this embodiment, the tank is fitted underneath with a series of diffusers 41 surrounding the injectors 31 linked to the supply station 19 of carburant gas. This latter consists as before of two bottles of propane, hydrogen, petrol residues (such as tetraine which is commercialized by the french company Air Liquide), acetylene, methane, etc.

It is obvious that the supply station 19, similarly with the supply stations 19 and 20 described in FIG. 1 can be erected at some distance from the explosion tank in a site or shelter specially constructed for this and not shown in the figures.

The operating method is much the same as before.

A predetermined quantity of carburant gas is injected when distributed by the diffusers 41 and mixed with the air contained within the tank. The air carburant mixture forces out the air originally in the tank through the mouth 12. When the tank is filled with the explosive mixture, a spark is made to cause the required explosion. This explosion, as before, moves exponentially towards the mouth of the tank and the blast and shock wave dislodge the layer of snow downstream.

A particularly important advantage of this device is that after a first unsuccessful or partially successful shoot, a second or even third explosion may be caused after the first. Another advantage is that it takes little place, is economical to install and use and is particularly safe because all manipulations of dangerous substances are carried out from a distance.

The device may be installed practically anywhere at the summit of any avalanche corridor, under a peak, on an overhang, etc.

The bottles of carburant gas and of oxygen can be installed during the summer and used during the winter to disperse dangerous accumulations of snow.

FIG. 3 represents a rear view of the tank 10 used in the installation represented in FIG. 1. The arrangement of the injectors of carburant 31 and of oxidising agent 32 are noted. The diameters of the feed-tubes of carburant 17 and of oxidising agent 18 are different which allows the required proportioning of the explosive mixture. In fact the best mixture consists of 1/6 carburant gas and 5/6 of gaseous oxidising agent.

In this example, the ignition device 29 is composed, for example of two electrodes 50 and 51 which are connected, by means of a link-cable 52, to a high voltage generator capable of generating a small electric arc between the two electrodes which then ignites the mixture.

FIG. 4 shows an embodiment in which the rigid explosion tube 10 is erected sideways. For reasons of commodity and economy, it takes the form of a cylinder closed at both ends. The explosion tank 10 in this case has five mouths 12 along its side surface linked to the body of the tank by truncated segments 13. The tank as before is mounted on concrete blocks 15 and held in position by rods 14 firmly anchored in the concrete blocks.

The advantage of this device is that the presence of several mouths 12 allows the blast produced by the explosion in the tank to be spread out over a larger surface, in a fan-shape. This effect may be augmented by a particular orientation of the axes of the mouths 12. On the other hand the series of mouths 12 may eventually be replaced by a single mouth with a rectangular shape. In this case, the height of the mouth will be exactly equal to the diameter of the mouths 12 represented by FIG. 4 and the length will be equal to a considerable part of the length of the tank.

Figure 2:
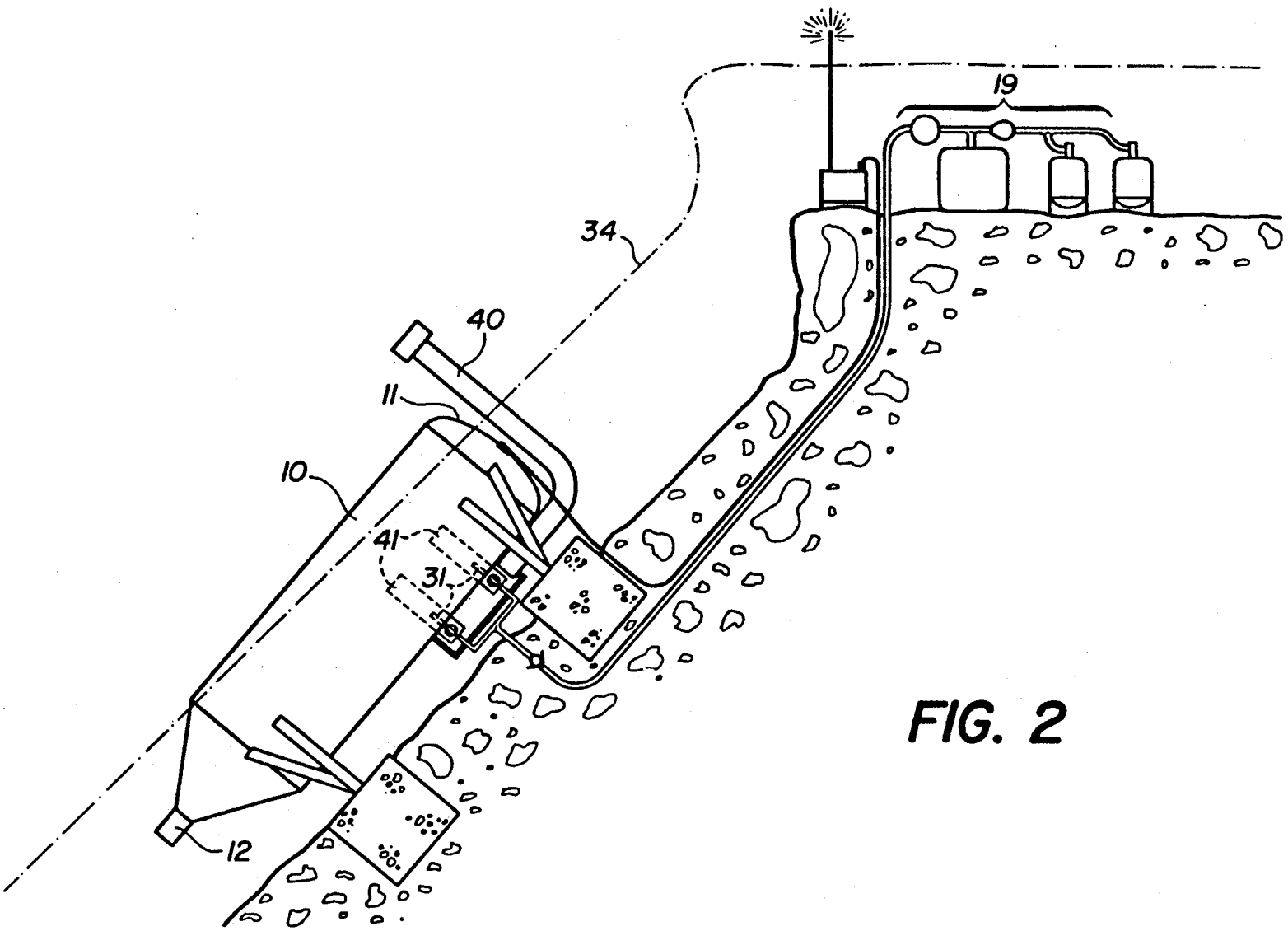
FIG. 2 represents a variation of the device in FIG. 1 in which air is used as gaseous oxidising agent.

It is understood that this tank is supplied with carburant gas and gaseous oxidising agent in the same way as described in FIGS. 1 and 2.

Figure 5:
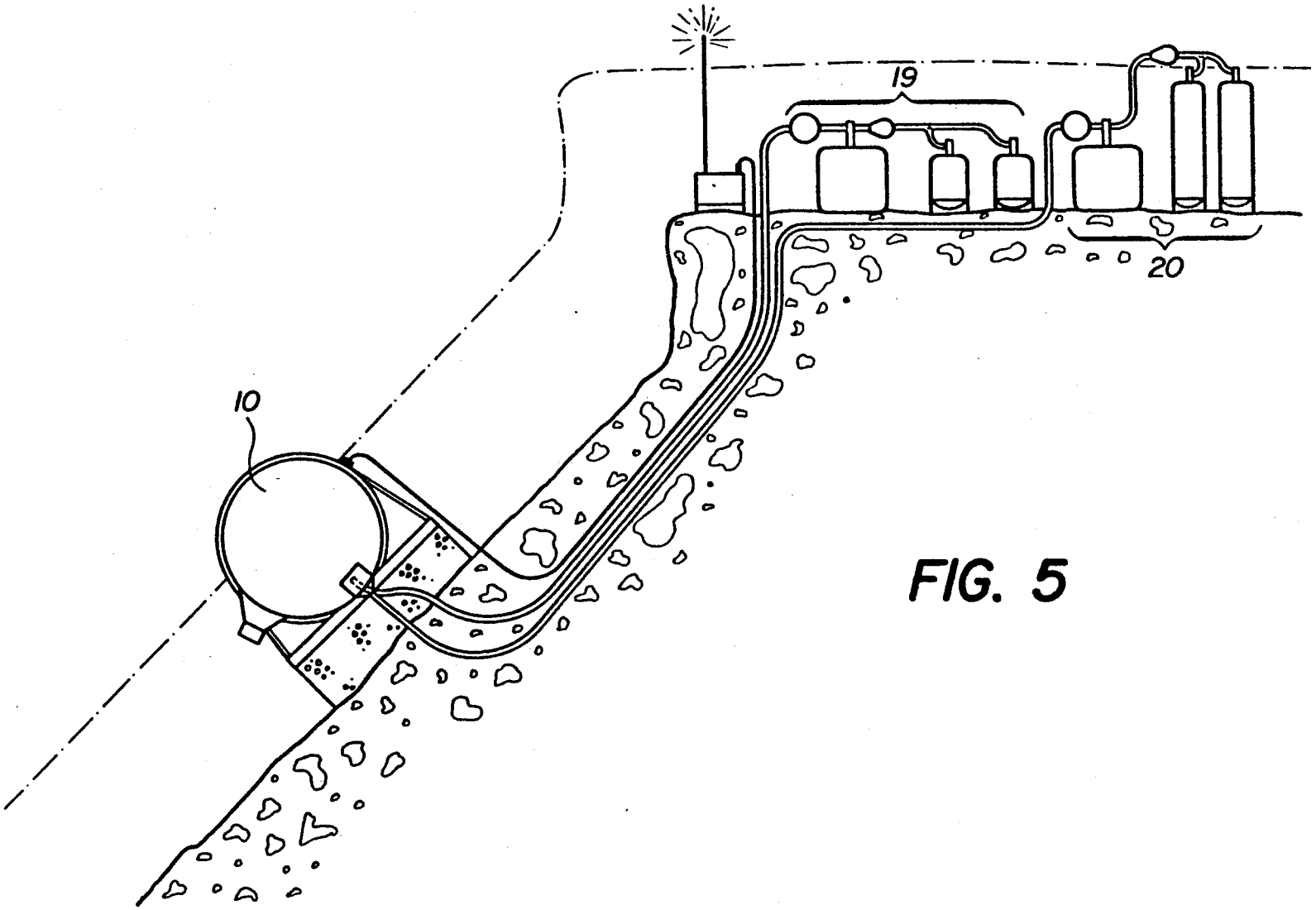
FIG. 5 represents a cross-section of FIG. 4.

In the embodiment shown in FIG. 5, the rigid explosion tank 10, arranged sideways is supplied with, for example propane and oxygen from two supply stations 19 and 20.

Figure 6:
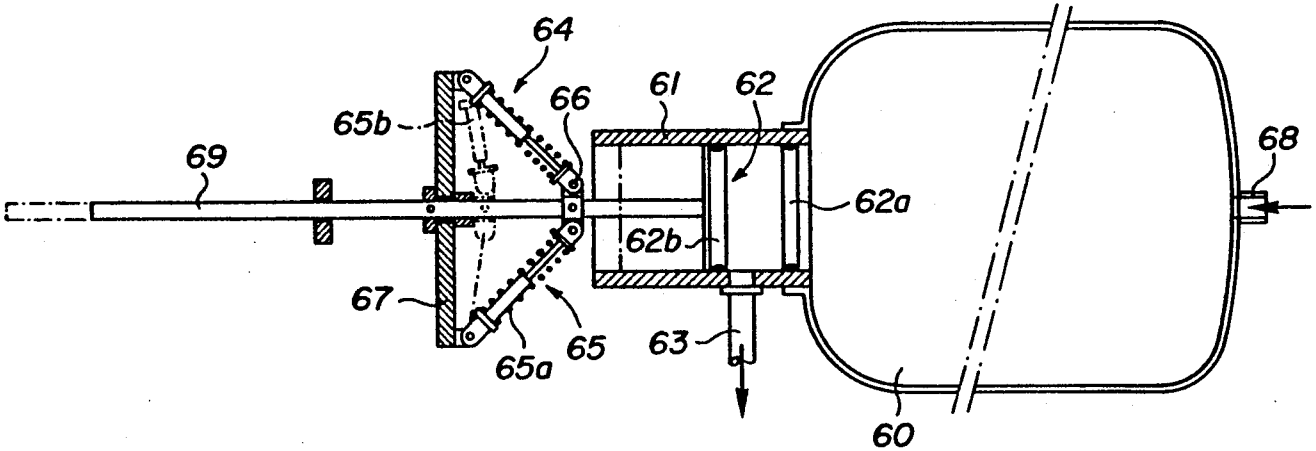
FIG. 6 shows a partial view of another embodiment of the device according to the invention.

FIG. 6 shows a mechanism associated with a buffer tank 60 to produce a spark by means of a flint struck against a wheel and mounted on the back wall of a rigid explosion tube. The filling tube 60 is linked to a cylinder 61 within a piston 62 can move, occupying an initial position **62*a* in which the evacuation mouth 63, linking to the filling tank 60 to the rigid explosion tank 10 (not shown) is blocked and a second position 62*b* in which the mouth 63 is open. The piston 62 is connected to a rod 69 on which is mounted an organ 64 comprising at least two springs 65 join at one end 66 to the rod 69 and at the other end to a fixed support 67 when the piston 62 is in its blocked position 62*a* the springs 65 are in position 65*a* shown in the complete lines and when piston 62 is in position 62*b*, the springs 65 are in the position 65*b*** shown in dashed lines.

When working, the filling tube is filled with gas under pressure injected into the mouth 68 and creates a pressure which pushes piston 62 from its position **62*a* to a position 62*b*. This movement of the piston has the effect of contracting the springs 65. Opening the evacuation orifice 63 lowers the pressure inside the filling tube and allows at a given moment, the sudden return of the springs 65 to their initial position 65*a***.

Figure 7:
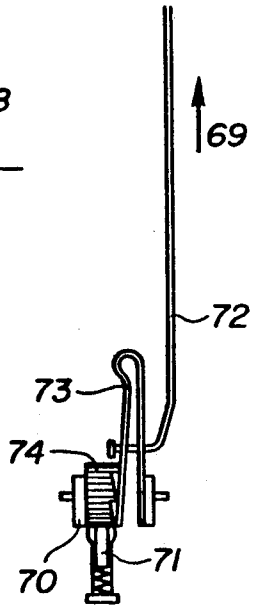
FIG. 7 represents an enlarged view of an ignition mechanism comprising a flint.

As shown in FIG. 7, a wheel 70 on which is supported a flint 71 can be rotated brusquely by a rod 72 appropriately linked to the rod 69 of the piston 20, so as to produce the spark causing the explosion within the tank.

Rotating the wheel 70 may be done for example by a flat spring 73 which works with a gearing 74 in the form of a ratchet arranged on one side of a corrugated wheel 70.

Figure 8:
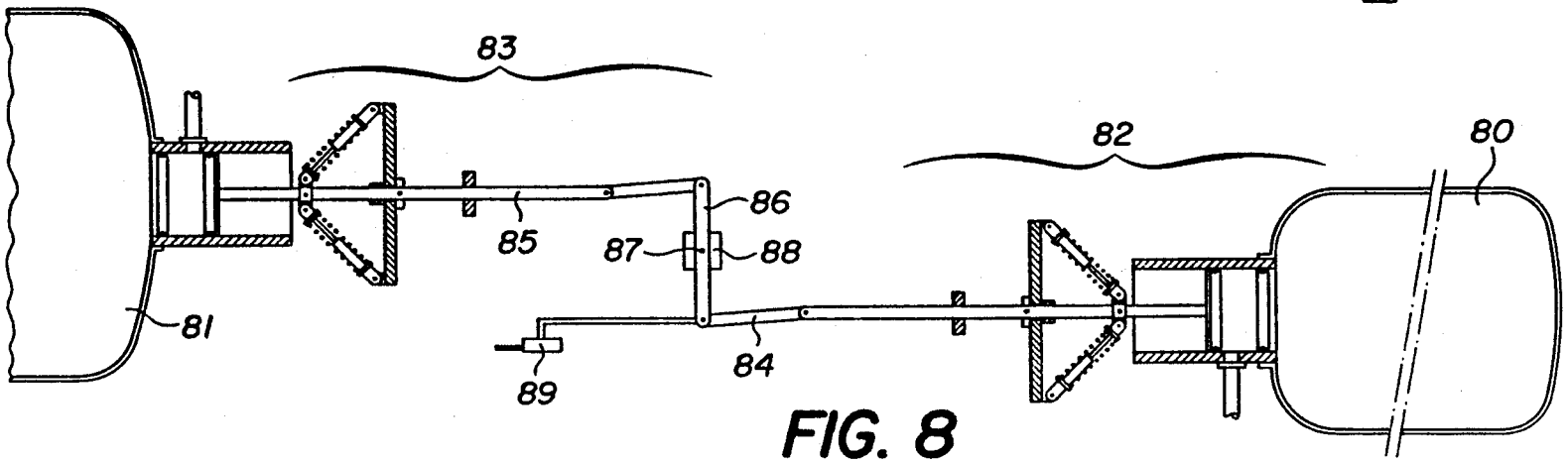
FIG. 8 shows a variation of the device shown in FIG. 6.

FIG. 8 represents a system suggested by the device shown in FIG. 6 which comprises a first buffer tank 80 which will receive carburant and a second buffer tank 81 which will receive oxidising agent. It is noted that the two tanks have appreciably different volumes, the second having a volume approximately four times the volume of the first one. The filling tank 80 is connected to a mechanism 82 which is much the same as that described with reference to FIG. 6 and the filling tank 81 is associated to a second mechanism 83 similar to mechanism 82. Each mechanism has a piston rod, 84 and 85 respectively which are joined to each end of a lever 86 pivoting on 87 on a fixed support 88. As before, an ignition device 89 comprising a flint, is associated to this mechanism.

This device is particularly useful in that the ignition can only happen when the two spring mechanisms are relaxed. While there exists a pressure within one of the two buffer tanks 80 and 81, the corresponding springs stay activated and the pivoting rod 86 stays in position, even if the other mechanism of the other filling tube is relaxed.

Figure 9:
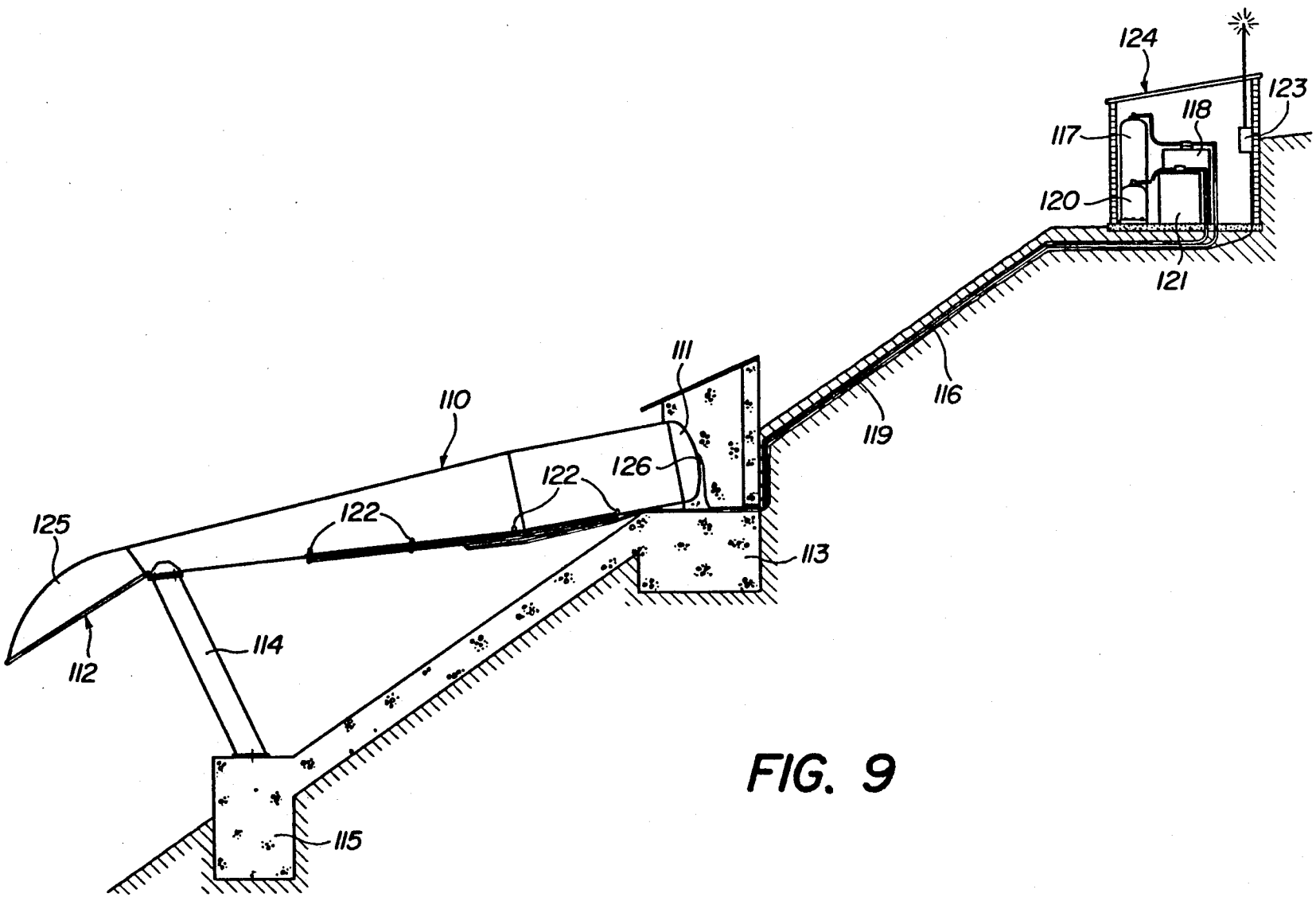
FIG. 9 shows a complete view illustrating another embodiment of the device according to the invention.

With reference to FIG. 9 the device represented consists essentially of an elongated cannon 110 having a closed base 111 and a front mouth 112 positioned opposite the closed base 111. The cannon 110 is fixed at its base by anchorage in a massive rigid construction 113, consisting for example of a block of concrete attached to the mountain side, and near its front end a supporting arm 114 itself supported by an anchorage block 115 made for example of concrete.

The cannon 110 is connected to an initial circuit 116 which ensures the provision of gaseous oxidising agent which preferably consists of oxygen from the reservoirs 117 of liquid oxygen via a buffer tank 118 which may be replaced by a flow-meter and on the other hand a second circuit 119 of gaseous carburant from a source 120 consisting for example of a bottle of propane or another combustible gas and crossing a filling tube 121 which may also be replaced by a flow-meter. The two circuits 116 and 119 lead into the interior of the cannon 110 by injection nozzles 122 which are designed simultaneously inject gaseous carburant and gaseous oxidising agent in the proportions required to give an explosive mixture.

As shown in the figure, the sources of gaseous oxidising agent 117 and carburant 120, together with the buffer tanks 118 and 121 and a distance control unit represented by the box 123 are best situated in a constructions 124 sited in a protected place above the cannon 110.

The cannon 110 in this embodiment, has a shape which narrows in the direction of the open mouth. This is equipped with a deflecting hood 125 whose purpose is to direct the blast resulting from the explosion within the cannon, towards the snow layer whose surface is preferably situated at several metres below the front mouth of the cannon, and to spread this blast over as wide an area as possible. It is noted that the height of the supporting arm 114 is calculated so that the front mouth is always positioned at approximately 2 m above the surface of the snow when it is decided to launch an avalanche.

In the example shown, the ignition is carried out by means of a sparking device 126 or by any other electrical, piezoelectric, explosive, mechanical, etc, means capable of producing a spark. In this embodiment, the sparking device is mounted on the closed base 111 of the cannon 110. In this case, the explosion begins in this zone and moves with increasing velocity in the direction of the open mouth 125. The blast resulting from the explosion and diffused by the deflecting hood 125, shakes the snow layer and launches an avalanche. The shock wave resulting from the explosion acts on the anchorage block 113 and travels across the rocky wall forming the base of the slope supporting the snow layer which is to be detached and causes a rupture in the base of this layer. The combined effects of the shock wave and the blast are normally sufficient to launch an avalanche following the explosion. If a first explosion is not sufficient to achieve the desired object, a new filling of the tank may be ordered from a distance and a second or even a third or fourth shot may be ordered to achieve the desired result.

FIG. 9 shows a device corresponding to an embodiment suitable in certain contexts defined by the geographical site of their implantation. Numerous embodiments may be imagined with respect to the local context of implantation of the system. The embodiment illustrated in FIG. 10 to 14 each respond to certain specific needs but all respect the basic principle of the device of FIG. 9.

Figure 10:
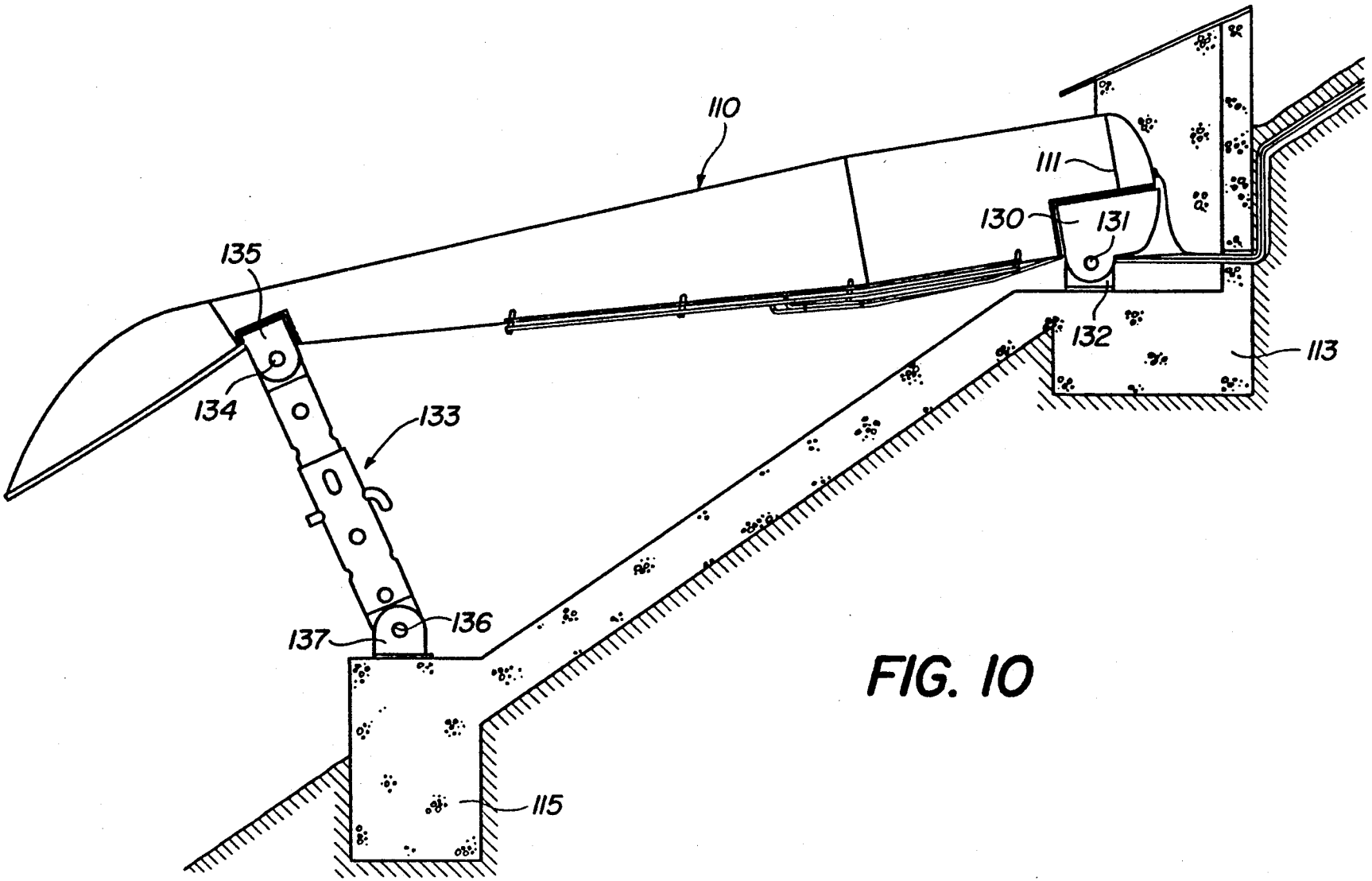
FIG. 10 shows a variation of the device shown in FIG. 9, and FIGS. 11 to 14 show two other embodiments of the device according to the invention.

FIG. 10 represents a device which differs from that of FIG. 9 by the fact the height of the cannon may be altered. To achieve this the closed base 111 of the cannon is placed on a support 130 which pivots round a fixed axis 131 on a support 132 which forms a unit with the anchorage block 113. The supporting arm 114 of the device in FIG. 9 has been replaced by a telescopic arm 133 which pivots around an axis 134 on a link 135 fixed to the cannon, and around an axis 136 on a solitary bridle 137, which forms a unit with the base or the column 115.

This embodiment allows the device to be installed in a site where the depth of the snow may be variable. The height of the front mouth of the cannon 110 being adjusted at the beginning of the winter season with respect to the average depths of the snow layer in previous seasons at the site where the device is to be installed.

Figure 11:
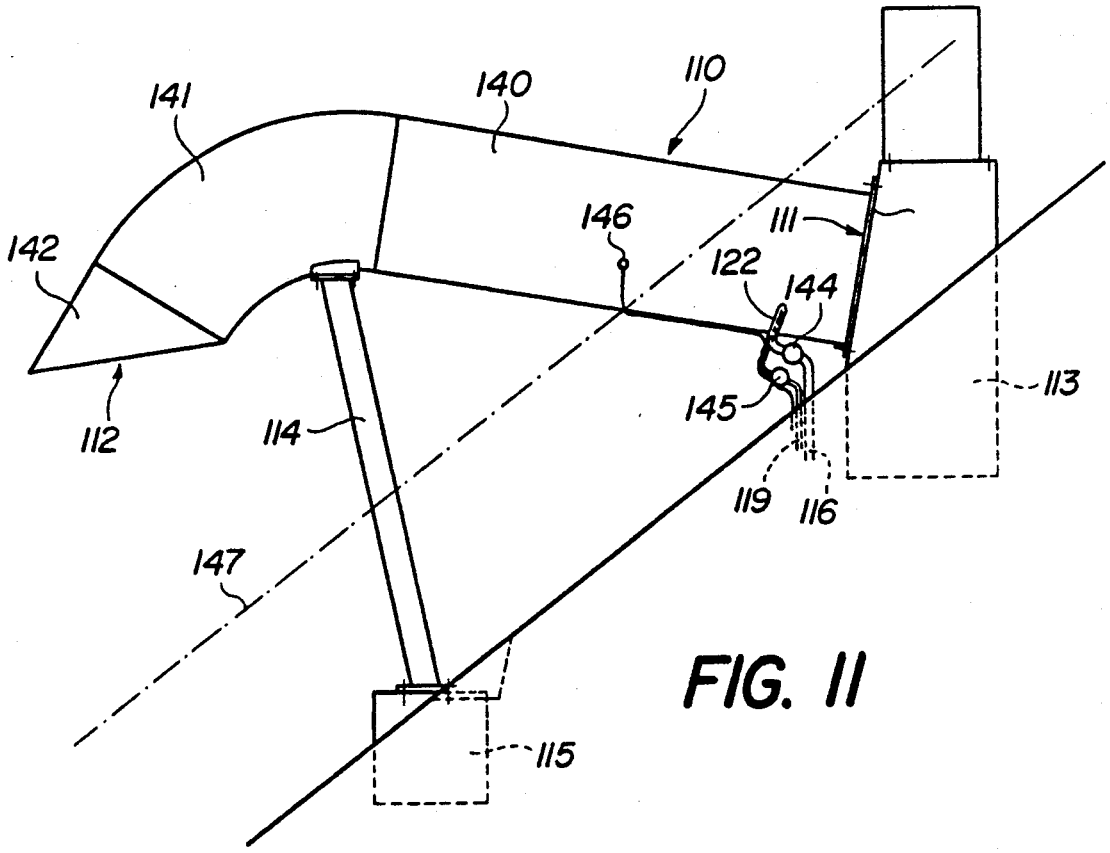

FIG. 11 represents another embodiment in which cannon 110 comprises a back cylindrical section 140 and a bent front section 141 which ends with a deflector 142 to define the front mouth 112 of the cannon. The closed base 111 of the cannon 110 consists of a thick plate of metal 143 which is fixed directly onto the anchorage block 113 whose base is, as before, linked to the wall of the mountain. The filling circuits 116 and 119 are connected respectively to controlled valves 144 and 145 which allow the injection respectively of gaseous oxidising agent and gaseous carburant by an injector 122 mounted on the rear section of the cannon 110. In this example, the ignition device 146 is mounted in part of the cannon situated approximately one third along its length. The explosion is started from this position and travels in two directions, i.e. towards the closed base of the cannon where it causes a shock wave which is transmitted to the anchorage block 113 to shake the base of the snow layer; and towards the front where it causes a blast which disturbs the snow layer represented by the line 147, on the surface in the zone situated under the said front mouth 112. The cannon as before is supported by an arm 14 fixed on a column or a block support 115. In the case where ignition occurs in the centre of the cannon, relativjely complex phenomena are note concerning the reflexion of the back wave of the double explosion in the open zone of the cannon.

Figure 12:
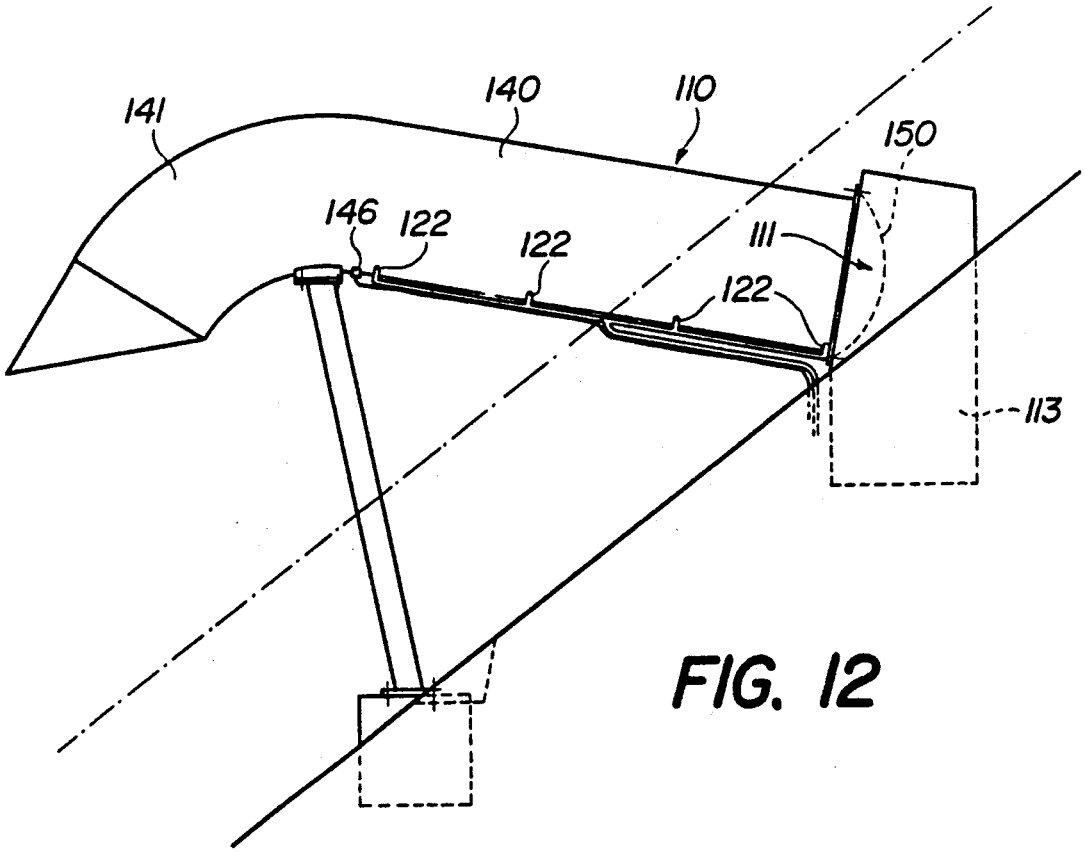

FIG. 12 shows an embodiment of the device in FIG. 11 in which the injection nozzle placed at the rear of the cannon 110 has been replaced by a series of injection nozzles 122 mounted at the base of the cylindrical section 140 of the cannon. The ignition device 146 has been moved forward to the junction of the cylindrical section 140 and the bent section 141. This embnodiment allows the reinforcement of the back wave and so generate a double explosion at the front of the cannon by means of a reflection occurring on the closed base 111 of the cannon. In this case, the closed base 111 has a rounded shape 150 which allows a better transmission of the shock wave to the anchorage block 113 and a good reflection of this wave towards the front mouth of the cannon.

Figure 13:
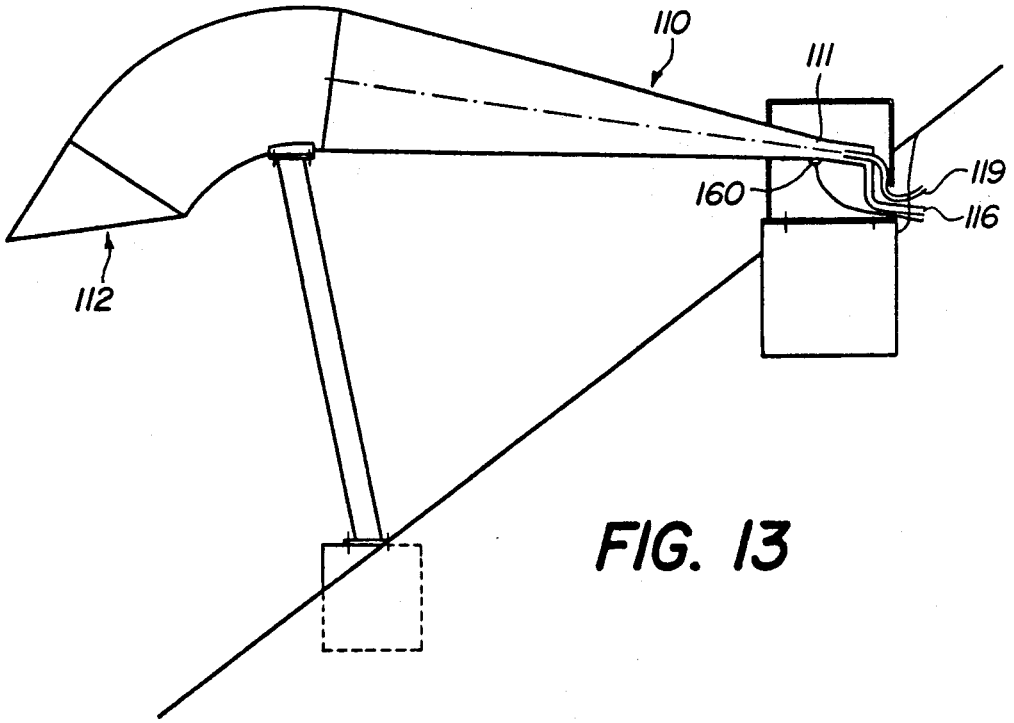

FIG. 13 shows another embodiment in which the cannon 110 presents a splayed shaped and section which increases from the closed base 111 to the front mouth 112. The feeding circuits of gaseous oxidising agent 116 and carburant 119 led into the back of the cannon at the level of the closed base which has the smallest section, and the ignition device 160 is place near this closed base. In this case, the explosion travels from the back to the front to create a blast acting on the upper surface of the snow layer.

Figure 14:
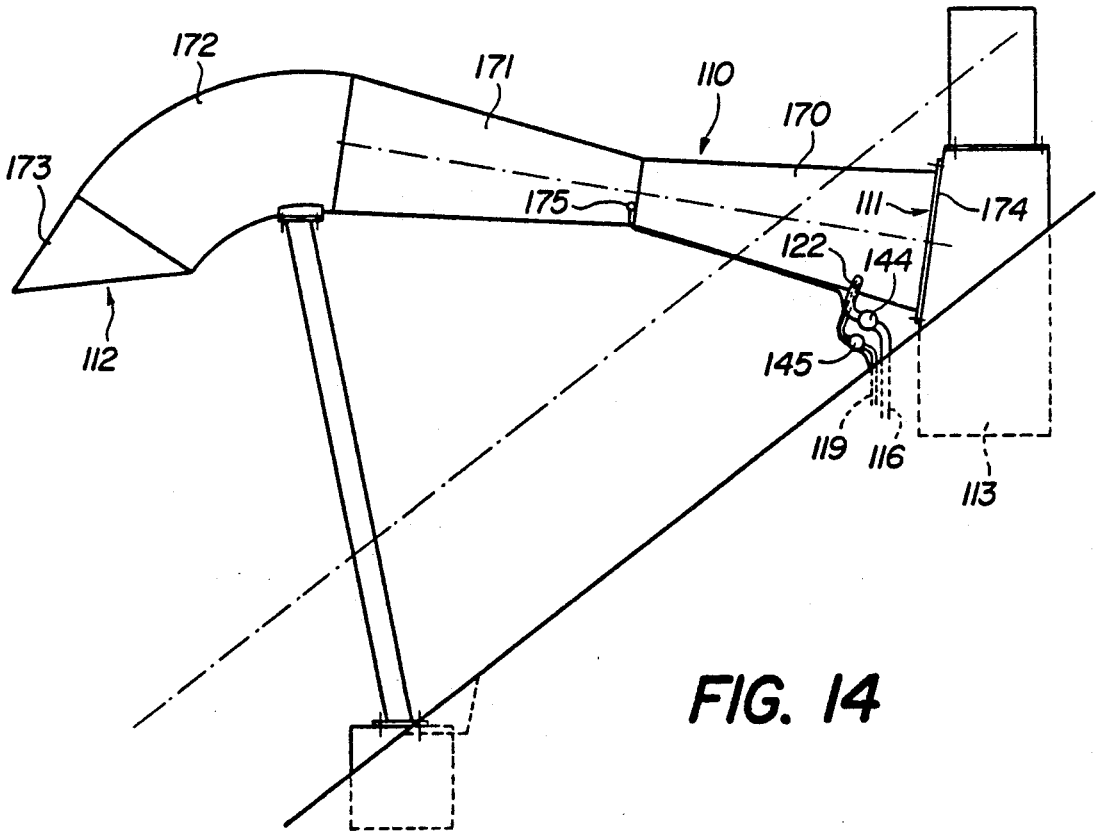

FIG. 14 shows another embodiment which to some extent is a combination between FIGS. 11 and 13.

The cannon 110 consists of a rear section 170 which narrows from the rear towards the front, a central section 171 which widens from the rear towards the front, a bend 172 which continues the central section 171 and a deflector 173 which defines the front mouth 112. The closed base 111 of the cannon 110 consists of a thick sheet of metal or steel 174 which is linked to the anchorage block 113. The filling with gaseous carburant and oxidising agents respectively is done by means of an injection nozzle 122 connected to circuits 116 and 119 by valves 144 and 145 identical to those represented by FIG. 11. The ignition device 175 is mounted on the junction of the two sections 170 and 171.

This device has the advantage of causing an explosion which travels in two directions, which has the effect of producing a surface action and an action at the base of the snow layer.

The present invention is not limited to the forms described but may have various modifications and exist in various embodiments. In particular, the ignition device could be conceived and made on the basis of the application of various other physical principles such as piezo-electricity. Or an explosive substance may be used, such as exists commercially. The disadvantage of that system is that only one shot is possible. The systems of the type piezo-electrical, mechanical associated with a flint or high potential electrode systems allow repeated firing in the cases when the first firing was partially or completely ineffective.

The form and the dimensions of the tanks must be adapted to the site to be protected. The controls for setting off the explosion can be varied according to the possibilities of access to the site.

I claim:

1. A method of causing an avalanche by detonating at least one explosion adjacent an area where an avalanche is to be created, said method comprising the steps of:

a) positioning an explosion container, having at least one opening in a surface thereof, so that the at least one opening faces the area where the avalanche is to be created;

b) introducing, at a pressure above atmospheric, a combustible gas and a gaseous oxidising agent into the explosion container to form an explosive mixture therein and allowing the explosive mixture to achieve approximately atmospheric pressure within the explosion container; and c) igniting the mixture contained within the explosion container to cause an explosion in which the blast of the explosion is directed out of the at least one opening toward the area where a said avalanche is to be created.

2. A method according to claim 1, further comprising the steps of simultaneously introducing the combustible gas and the oxidising agent into the explosion container through a mixing device to produce a homogeneous mixture thereof.

3. A method according to claim 1, further comprising the step of igniting the mixture by producing a spark within the explosion container adjacent an area remote from the at least one opening.

4. A method according to claim 1, further comprising the step of placing the explosion container adjacent the ground with the at least one opening pointed in a direction of the slope of the area to be cleared.

5. A method according to claim 1, further comprising the step of using a cannon shaped member having a closed base at one end thereof and the opening at the opposite end thereof as the explosion container, and positioning the cannon so that the blast, and associated shock wave, resulting from the explosion exits the opening and is directed above a layer of snow to be cleared by a said avalanche.

6. A method according to claim 5, further comprising the step of igniting the mixture in an intermediary zone situated between the closed base and the opening of the cannon.

7. A method according to claim 1, further comprising the step of preparing the mixture by supplying the combustible gas and the oxidising agent to the explosion container from respective pressurized gas supply containers via filling conduiuts, in which the gases in the containers are at a pressure above atmospheric pressure.

8. A method according to claim 1, further comprising the step of preparing the mixture by supplying the combustible gas and the oxidising agent, respectively, from their gas supply containers through flow-meters to measure the respective volumes of the gases.

9. A device for causing an avalanche by detonating at least one explosion adjacent an area where an avalanche is to be created, said device comprising:

a rigid explosion container (10) having at least one completely unobstructed opening provided in a surface thereof, said completely unobstructed opening always being in direct communication with the atmosphere located outside of the explosion container (10), means (16) for supplying the explosion container with a combustible gas and an oxidising agent, at a pressure above atmospheric, to form an explosive mixture therein and allowing the explosive mixture to achieve approximately atmospheric pressure within the explosion container prior to an explosion, and means (30) for generating an explosion of the mixture within the rigid explosion container, whereby the blast of the explosion is directed out of the at least one completely unobstructed opening toward the area where the avalanche is to be created.

10. A device according to claim 9, wherein at least one gas supply container (21) for the combustible gas and at least one gas supply container for the oxidising agent are provided, feed conduits (17, 18) connect the explosion container (10) to the gas supply containers, and valves (24, 28) are connected to the feed conduits to control the passage of the combustible gas and the oxidising agent to the explosion container.

11. A device according to claim 9, wherein the explosion container (10) is equipped with mixing means (31, 32) to ensure a homogeneous mixture of the gases within the explosion container.

12. A device according to claim 9, wherein the means for generating an explosion comprises a spark producing device located in the interior of the container.

13. A device according to claim 9, wherein the rigid explosion container is mounted adjacent the ground and the at least one opening (12) faces toward the slope of the area to be cleared.

14. A device according to claim 9, wherein an interior surface of the explosion container is cylindrical in shape and closed at an end (11) thereof opposite the at least one opening, the diameter of the at least one opening is smaller than the diameter of the remainder of the explosion container, and the at least one opening is connected with the remainder of the explosion container by a conical section.

15. A device according to claim 14, wherein an ignition device (29), designed to produce a spark, is mounted adjacent the closed end (11) of the explosion container.

16. A device according to claim 9, wherein the rigid explosion container has the shape of a cannon (110) comprising a closed end (111) and an open end (112), and the closed end is at least partially anchored to the ground and the open end (112) is positioned above the snow to be cleared by a said avalanche.

17. A device according to claim 16, wherein the cannon (110) is equipped with means (126) for producing a spark in an intermediary zone between the closed end (111) and the open end (112).

18. A device according to claim 16, wherein the open end (112) of the cannon is equipped with means (125) for assuring diffusion of the blast.

19. A device according to claim 18, wherein the open end (112) of the cannon comprises a widened out section to spread the blast caused by the explosion.

20. A device according to claim 16, wherein the cannon (110) is elongate and the interior cross section of the cannon progressively narrows from the closed end toward the open end.

21. A device according to claim 9, wherein the rigid explosion container (10) is an elongate cylindrical member having severaal opening (12) arranged along a side wall of the explosion container.

22. A method of causing an avalanche by detonating at least one explosion adjacent an area where an avalanche is to be created, said method comprising the steps of:

a) positioning an explosion container, having at least one completely unobstructed opening, always in direct communication with the atmosphere located outside of the explosion container, in a surface thereof so that the at least one completely unobstructed opening faces the area where the avalanche is to be created;

b) introducing, at a pressure which is higher than atmospheric pressure, a combustible gas and a gaseous oxidising agent into the explosion container to form an explosive mixture therein and allowing the explosive mixture to achieve approximately atmospheric pressure within the explosion container; and c) igniting the mixture contained within the explosion container to cause an explosion in which the blast of the explosion is directed out of the at least one completely unobstructed opening toward the area where a said avalanche is to be created.

* * * * *